US009783392B2

(12) United States Patent
Kim et al.

(10) Patent No.: US 9,783,392 B2
(45) Date of Patent: Oct. 10, 2017

(54) ELEVATOR DOOR STOPPING DEVICE

(71) Applicant: Otis Elevator Company, Farmington, CT (US)

(72) Inventors: Jung Sam Kim, Seoul (KR); Jinkoo Lee, Gyeonggi-do (KR); Hansoo Shim, Seoul (KR); JinKyu Ryu, Incheon (KR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/761,163

(22) PCT Filed: Sep. 12, 2013

(86) PCT No.: PCT/US2013/059421
§ 371 (c)(1),
(2) Date: Jul. 15, 2015

(87) PCT Pub. No.: WO2014/133587
PCT Pub. Date: Sep. 4, 2014

(65) Prior Publication Data

US 2016/0009529 A1 Jan. 14, 2016

(30) Foreign Application Priority Data

Feb. 27, 2013 (KR) ..... 10-2013-0021320

(51) Int. Cl.
*B66B 13/16* (2006.01)
*B66B 13/08* (2006.01)

(52) U.S. Cl.
CPC ..... *B66B 13/16* (2013.01); *B66B 13/08* (2013.01)

(58) Field of Classification Search
CPC ..... B66B 13/16; B66B 13/08
(Continued)

(56) References Cited

U.S. PATENT DOCUMENTS 5,134,324 A * 7/1992 Sakagami ..... E05F 15/60 104/281
5,852,897 A * 12/1998 Sukale ..... B66B 13/08 310/67 R (Continued)

FOREIGN PATENT DOCUMENTS

JP 2001-226058 A 8/2001
JP 2007-302424 A 11/2007
WO WO 2011-142780 A1 11/2011

OTHER PUBLICATIONS

International Search Report and Written Opinion for related International Application No. PCT/US13/59421; report dated Dec. 26, 2013.

*Primary Examiner* — Michael Riegelman
(74) *Attorney, Agent, or Firm* — Cantor Colburn LLP

(57) ABSTRACT

An elevator door stopping device which can prevent that elevator door is closed by itself when power supplied to a motor for opening and closing the elevator door is interrupted, an improvement of the elevator door stopping device characterized in that a first magnetic body is fixed on a shaft rotating in interlock with opening and closing of the elevator door so as to generate a magnetic force in a radial direction perpendicular to the shaft, and a second magnetic body is fixed on a fixed face spaced apart from the first magnetic body at a predetermined interval in the radial direction in such a manner that the second magnetic body has the opposite pole to the first magnetic body, so that a magnetic force is generated between the first magnetic body and the second magnetic body in the radial direction perpendicular to the shaft.

12 Claims, 7 Drawing Sheets

(58) Field of Classification Search
USPC ..... 187/331
See application file for complete search history.

(56) References Cited

U.S. PATENT DOCUMENTS

| | | | | |
|---|---|---|---|---|
| 6,467,584 | B2 * | 10/2002 | Yamamoto | H02K 41/031 187/289 |
| 6,588,811 | B1 * | 7/2003 | Ferguson | E05B 1/0007 16/320 |
| 6,974,522 | B2 * | 12/2005 | Peresada | H02K 1/2786 156/293 |
| 2006/0060428 | A1 * | 3/2006 | Hashiguchi | B66B 11/043 187/254 |
| 2006/0196733 | A1 | 9/2006 | Tonna et al. | |
| 2007/0267930 | A1 | 11/2007 | Ogava | |
| 2008/0202860 | A1 * | 8/2008 | Flynn | B66B 13/08 187/316 |

* cited by examiner

ELEVATOR DOOR STOPPING DEVICE

CROSS-REFERENCE TO RELATED APPLICATION

This application is a 35 USC 371 national stage filing of International Patent Application Serial No. PCT/US13/59421 filed on Sep. 12, 2013 and claiming priority to Korean Patent Application No. 10-2013-0021320 filed on Feb. 27, 2013.

TECHNICAL FIELD OF THE DISCLOSURE

The present invention relates to an elevator door stopping device.

BACKGROUND OF THE DISCLOSURE

Referring to FIGS. 1-3 and particularly, to FIGS. 2 and 3, a conventional elevator door stopping device as disclosed in Korean Patent No. 10-1173360 is shown. Specifically, the conventional elevator door stopping device includes an elevator door header installed on one end of a motor 30. A motor pulley 33 is fixed to a shaft 32 of the motor 30. A first magnetic material 80 is provided on the motor pulley 33, while a second magnetic material 90 is provided on an inner surface of a motor housing 34.

A magnetic force is generated between the first magnetic material 80 and the second magnetic material 90. Often, because the magnetic force acts in an axial direction, it causes the shaft 32 to deviate from its original position during an assembling process of the motor components. Therefore, undesirable noise is generated when the motor 30 is operated. Accordingly, there is a need for an improved mechanism to prevent or at least minimize the deviation of the shaft 32 and thereby reduce the generated noise.

SUMMARY OF THE DISCLOSURE

The present invention provides an elevator door stopping device that a first magnetic body is attached and fixed on a rotary shaft of a motor for opening and closing an elevator door so as to generate a magnetic force in a radial direction perpendicular to the rotary shaft, and a second magnetic body is attached and fixed on an inner fixed face of a motor housing spaced apart from the first magnetic body at a predetermined interval in the radial direction in such a way as to have the opposite pole to the first magnetic body, so that a magnetic force (attraction) is generated between the first magnetic body and the second magnetic body in the radial direction perpendicular to the rotary shaft, thereby preventing that car doors are closed by themselves because rotation of a motor pulley is stopped by the attraction between the first and second magnetic bodies when power supplied to the motor is interrupted.

Furthermore, the present invention provides an elevator door stopping device, which can prevent the problem that noise is generated during the operation of the motor because the rotary shaft of the motor is deviated from its original position due to the attraction between the first and second magnetic bodies acting in an axial direction during an assembling process of motor components.

BRIEF DESCRIPTION OF THE DRAWINGS

Hereinafter, the detailed description of the present invention will focus on characteristic parts of the present invention which are contrasted with the prior art (Korean Patent No. 10-1173360) shown in FIGS. 1 to 3, and detailed descriptions on constitutions having functions equal or similar to the prior art will be omitted.

DETAILED DESCRIPTION OF THE DISCLOSURE

Figure 1:
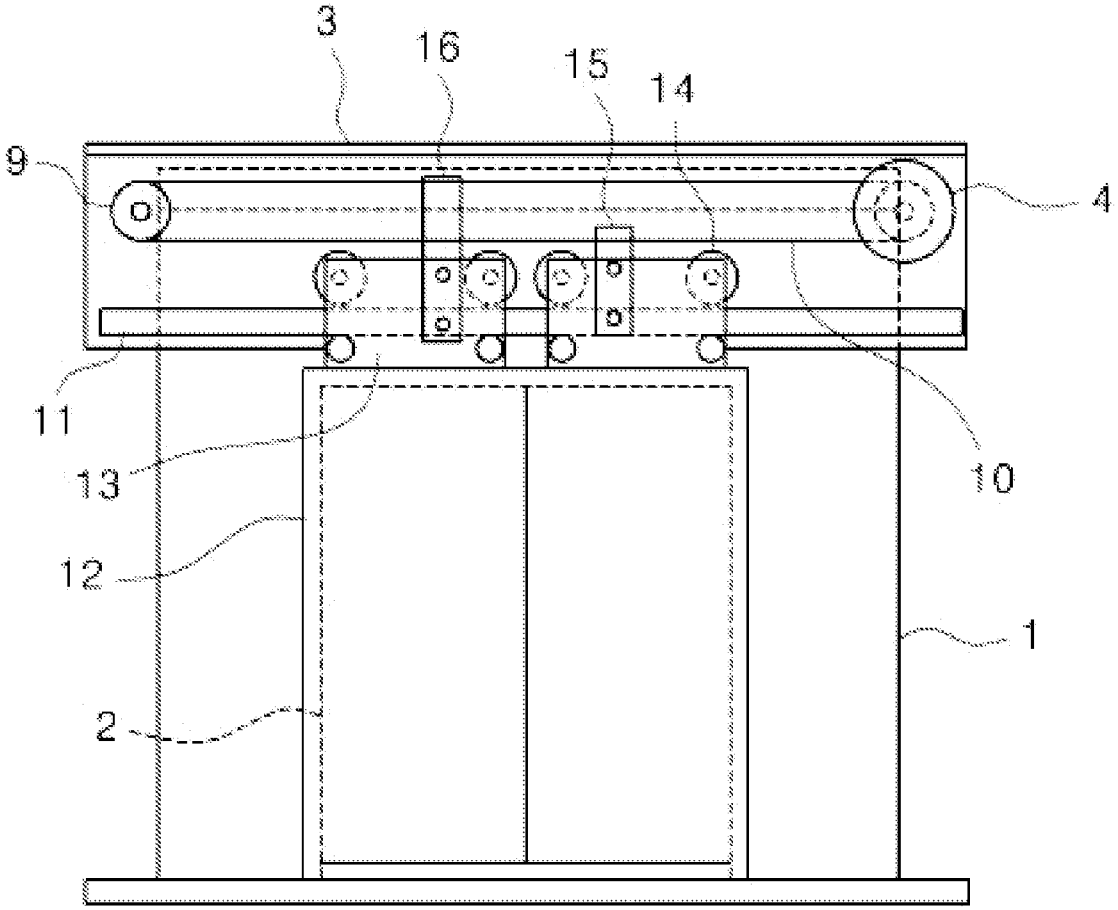
FIG. 1 (Prior Art)
Figure 2:
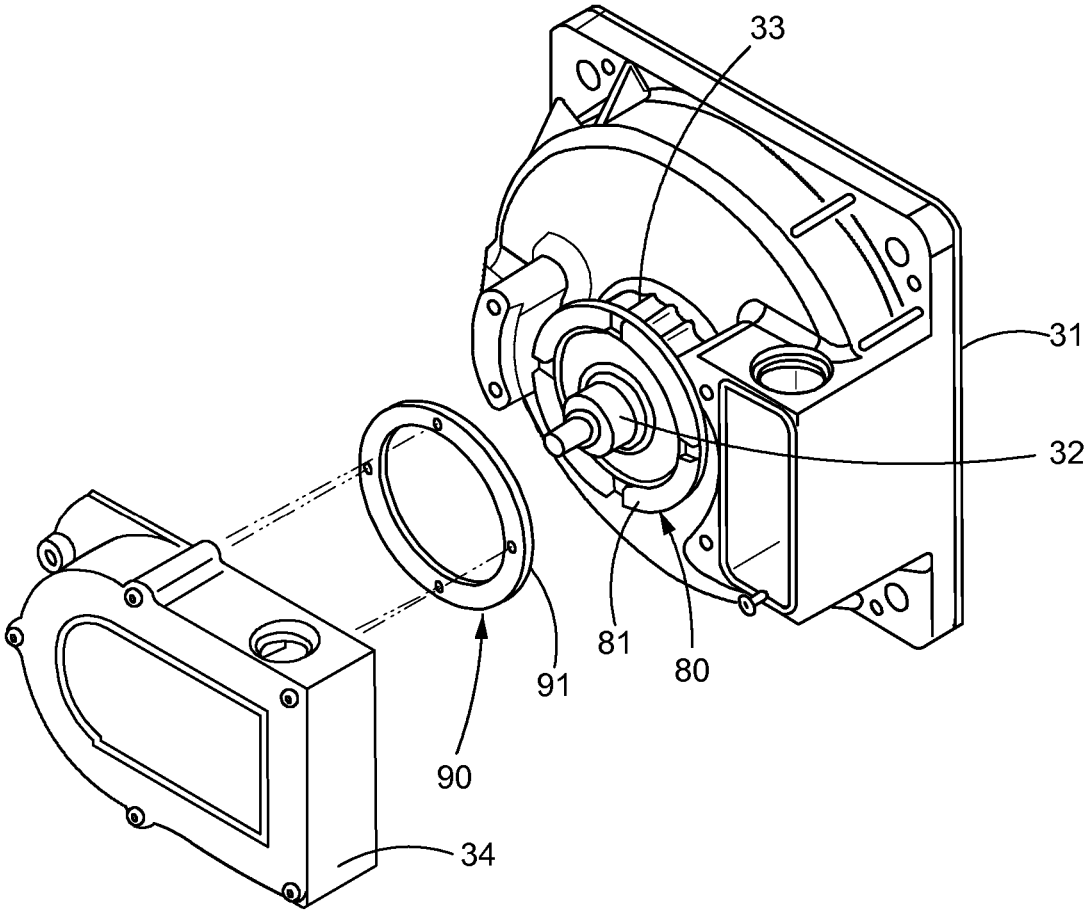
FIG. 2 (Prior Art)
Figure 3:
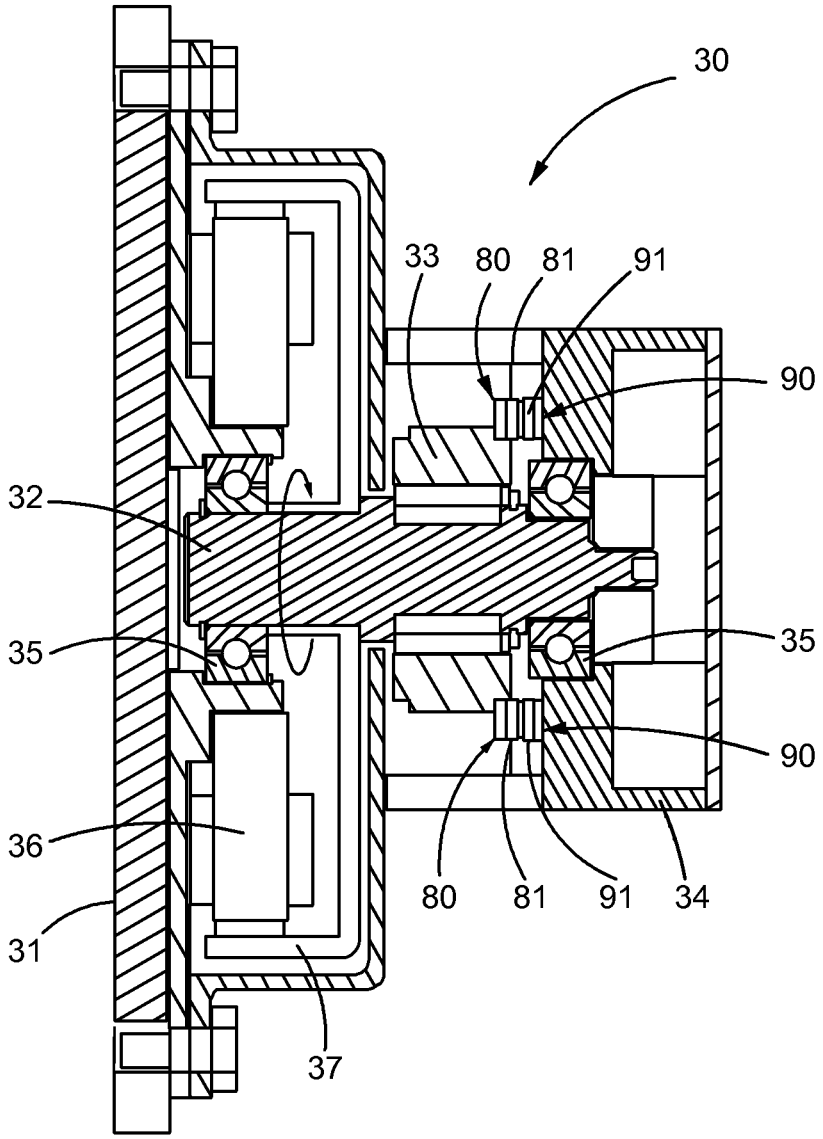
FIG. 3 (Prior Art)
Figure 4:
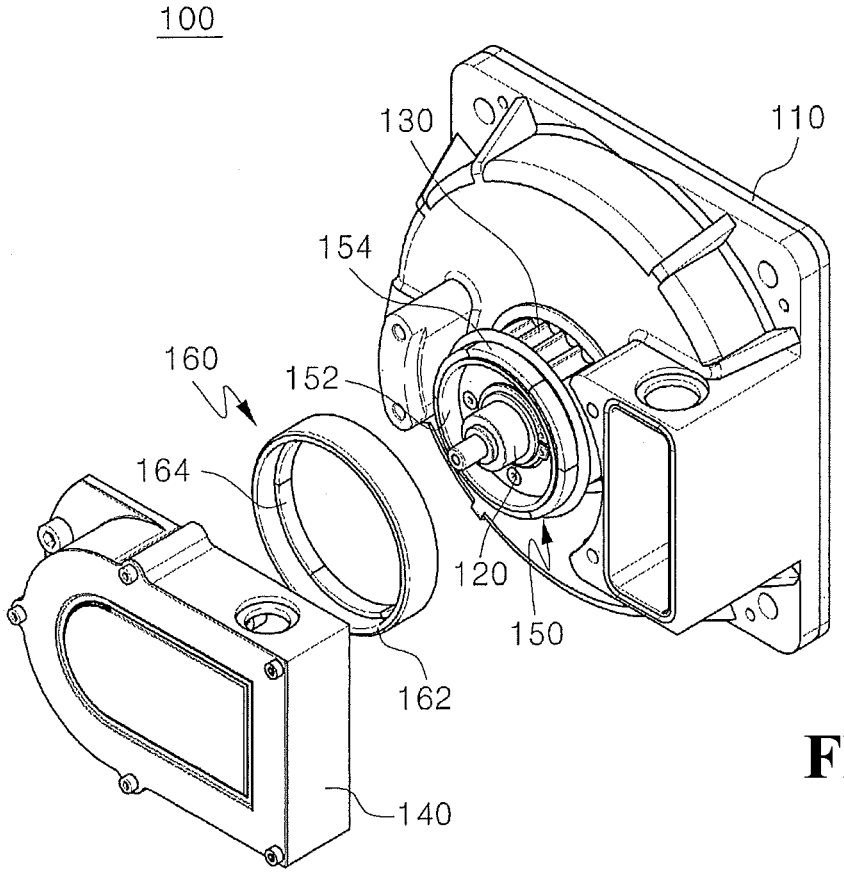
FIG. 4 is an exploded perspective view showing essential parts of a motor mounted in an elevator car door stopping device according to a preferred embodiment of the present invention.
Figure 5:
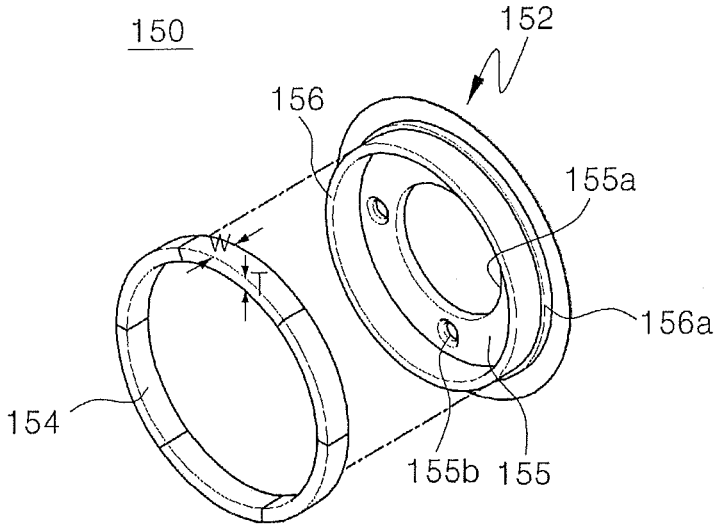
FIGS. 5 and 6 are detailed diagrams respectively showing structures of a first magnetic body and a second magnetic body disposed in the motor of FIG. 4. Moreover.
Figure 6:
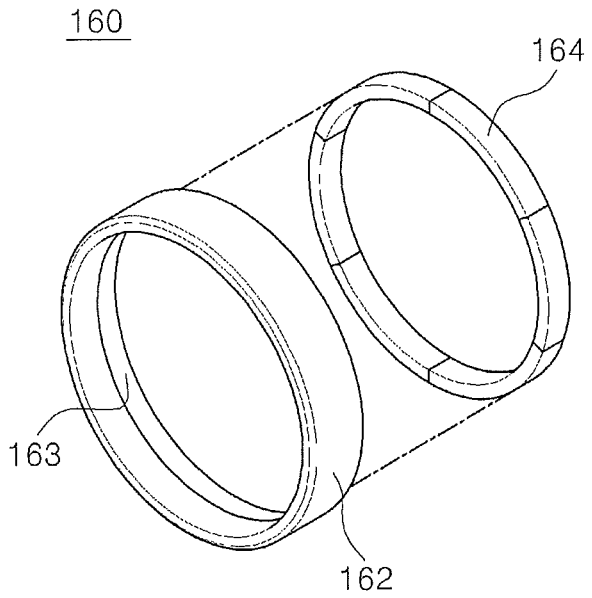
Figure 7:
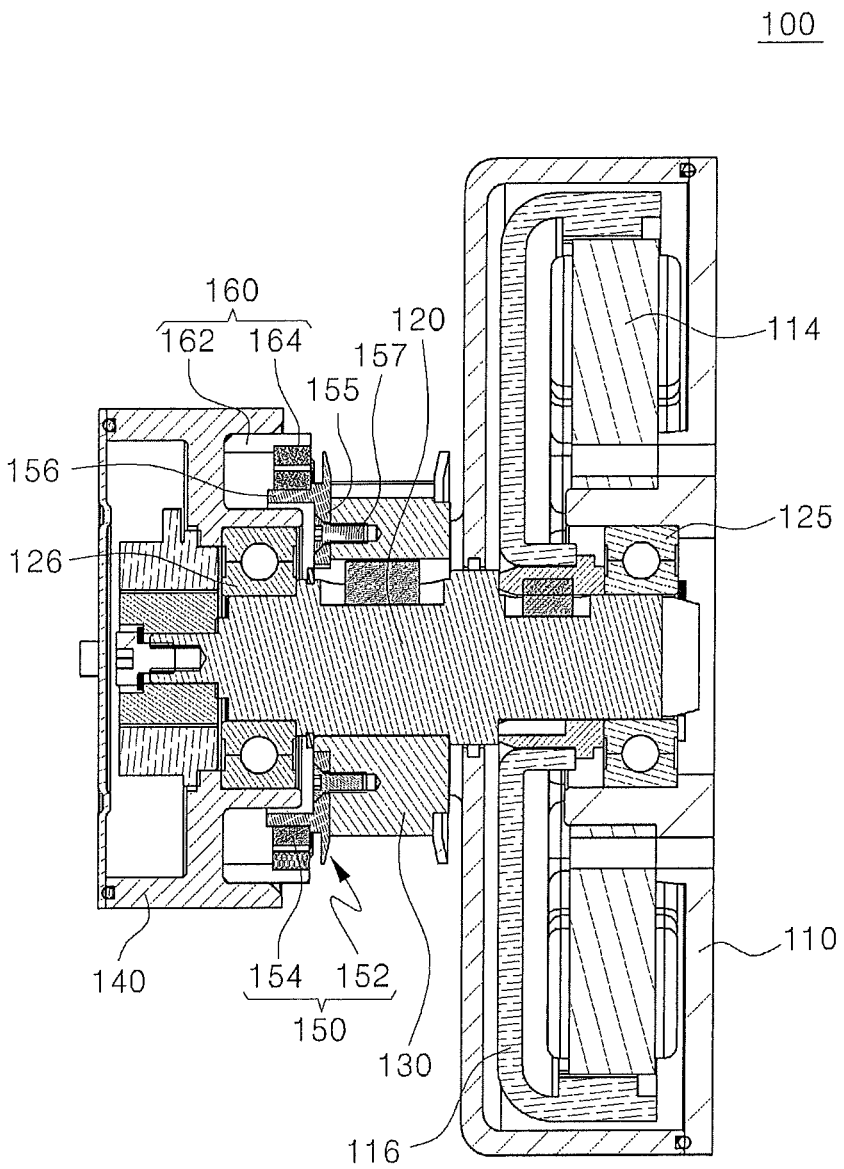
FIG. 7 is a sectional view showing an internal structure of the motor of the elevator car door stopping device according to the present invention.

Referring to FIGS. 4 to 7, the elevator door stopping device according to the present invention includes a motor 100 connected with a driven pulley mounted at one side of a car door header of the elevator through a timing belt so as to provide a driving force for opening and closing a car door.

The motor 100 includes: a motor base 110 fixed to the car door header; a rotary shaft 120 axially rotated at a middle portion of the motor base 110; a motor pulley 130 joined integrally with the outer circumferential surface of the rotary shaft 120 and rotated in interlock with the rotary shaft 120; a motor housing 140 covering a front end portion of the rotary shall 120; a first magnetic body 150 joined to a front end face (front face) of the motor pulley 130 interlocking with the motor pulley 130 so as to be axially rotated; and a second magnetic body 160 fixed on an inner circumference portion of the motor housing 140 spaced apart from the first magnetic body 150 at a predetermined interval in a radial direction (perpendicularly to the rotary shaft) and having a pole opposed to the first magnetic body 150 so that the first magnetic body 150 and the second magnetic body 160 attract each other.

The first magnetic body 150 is joined and fixed to the front end face (front face) of the motor pulley 130 joined on the outer circumferential surface of the rotary shaft 120 of the motor 100 so as to be rotated in interlock with the motor pulley 130 when the motor pulley 130 rotates. Such a first magnetic body 150 generates a magnetic force in a radial direction perpendicular to the rotary shaft 120 of the motor 100.

The first magnetic body 150 includes: a first magnetic body plate 152 fixed to the front end face (front face) of the motor pulley 130; and a plurality of first permanent magnets 154 (six permanent magnets in this embodiment) attached and fixed along the outer circumferential surface of the first magnetic body plate 152.

Moreover, the first magnetic body plate 152 includes: a disc-shaped joining portion 155 joined to the front end face of the motor pulley 130 via a bolt 157; and a cylindrical fixing portion 156 formed integrally with the joining portion 155 in a perpendicular direction and having the plural first permanent magnets 154 attached to the outer circumferential surface thereof.

The joining portion 155 has a through hole 155*a* through which the rotary shaft 120 of the motor 100 passes, and on the outer edge where the joining portion 155 and the fixing portion 156 meet together, formed is a support jaw 156*a* for supporting the first permanent magnet 154 and keeping a predetermined distance between the first permanent magnet 154 and the joining portion 155. Furthermore, a plurality of joining holes 155*b* to which bolts 157 are fastened are formed in the joining portion 155 located inside the fixing portion 156.

The first permanent magnet 154 has a structure that a cylindrical permanent magnet is divided into several parts in a circumferential direction. That is, the divided first permanent magnets 154 respectively have a circular arc shape that a back-and-forth direction width (W) which is parallel with the rotary shaft 120 of the motor 100 is larger than a radial direction thickness (T) perpendicular to the rotary shaft 120.

The first permanent magnets 154 are arranged along the outer circumferential surface of the fixing portion 156 of the first magnetic body plate 152 and attached and fixed in such a way as to form a circle. In this instance, the first permanent magnets 154 arranged closely to each other have different poles from one another, namely, the opposite poles of the first permanent magnets 154 are arranged by turns along the circumferential direction. The first permanent magnets 154 may be mounted closely to one another or may be mounted to be space apart from one another at predetermined intervals.

In the meantime, the second magnetic body 160 which has the opposite pole to the first magnetic body 150 is fixed on the outer circumferential portion spaced apart from the first magnetic body 150 at a predetermined interval, and generates a magnetic force in the radial direction perpendicular to the rotary shaft 120.

In concretely, the second magnetic body 160 includes a cylindrical second magnetic body plate 162 fixed on the inner circumferential surface of an end portion of one side of the motor housing 140; and a plurality of second permanent magnets 164 attached and fixed to the inner circumferential surface of an end portion of one side of the second magnetic body plate 162. Additionally, a support jaw 163 for supporting the second permanent magnets 164 not to be moved in the attached state of the second permanent magnet 164s is formed on the inner circumferential surface of the second magnetic body plate 162.

The second permanent magnets 164 has the same shape and the same arrangement structure as the first permanent magnets 154 of the first magnetic body 150, and the adjacent second permanent magnets 164 are arranged along the circumferential direction in such a manner that the opposite poles of the second permanent magnets 164 are arranged by turns.

As described above, the second permanent magnets 164 are spaced apart from the outer circumferential surface of the first permanent magnets 154 at the predetermined interval in the radial direction perpendicular to the rotary shaft 120, and the second permanent magnets 164 are respectively arranged in such a way as to have the poles which are opposed to the poles of the first permanent magnets 154 arranged inside the second permanent magnets 164, so that a magnetic force (attraction) is generated between the first permanent magnets 154 and the second permanent magnets 164 in the radial direction.

In the drawings, the unexplained reference numerals 125 and 126 designate bearings interposed among the rotary shaft 120, the motor base 110 and the motor housing 140, 114 designates a stator, and 116 designates a rotor.

Meanwhile, as described above, the first and second permanent magnets 154 and 164 of the first and second magnetic bodies 150 and 160 are arranged in such a manner that the opposite poles are arranged in the circumferential direction by turns.

Figure 8A:
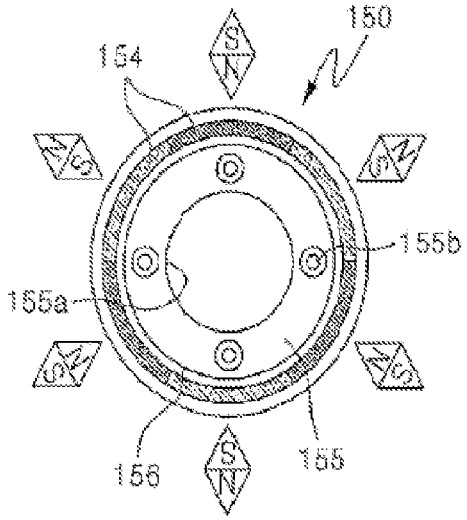
FIGS. 8A, 8B, 9A and 9B depict a first magnetic body and second magnetic body in example embodiments.
Figure 8B:
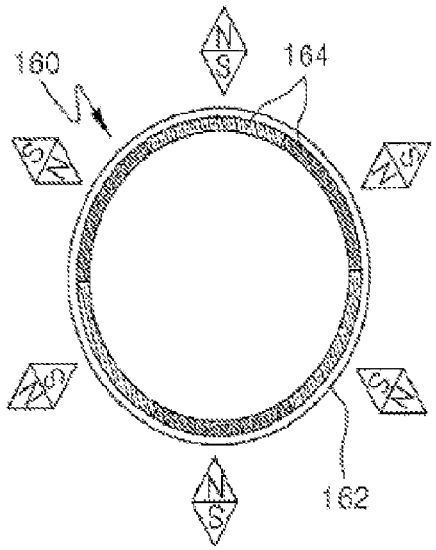

For instance, as shown in FIGS. 8A and 8B, the plural first permanent magnets 154 of the first magnetic body 150 are arranged by turns in order of N pole→S pole→N pole→S pole in the clockwise direction, and the plural second permanent magnets 164 of the second magnetic body 160 are arranged by turns in order of S pole→N pole→S pole→N pole in the clockwise direction, so that the magnetic force (attraction) is generated between the first permanent magnets 154 and the second permanent magnets 164 in the radial direction because the first permanent magnets 154 and the second permanent magnets 164 have different poles in the radial direction.

In the above arrangement, because the rotary force of the motor 100 is stronger than the magnetic force between the first and second permanent magnets 154 and 164 while the motor pulley 130 is forcedly rotated by the rotary shaft 120, the attraction does not work. However, when power supplied to the motor 100 is interrupted, because the attraction generated between the first permanent magnets 154 and the second permanent magnets 164 takes effect, it can prevent that the motor pulley 130 is rotated by itself.

Figure 9A:
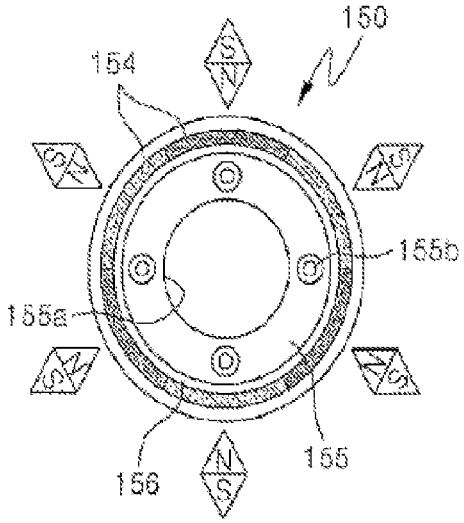
Figure 9B:
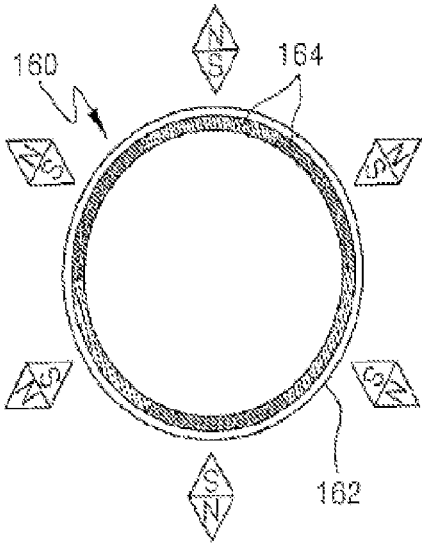

Alternatively, in another preferred embodiment of the present invention, as shown in FIGS. 9A and 9B, all of the plural first permanent magnets 154 of the first magnetic body 150 have the same poles and all of the plural second permanent magnets 164 of the second magnetic body 160 have the same poles and the first and second permanent magnets corresponding in the radial direction have different poles from each other.

In other words, the plural first permanent magnets 154 of the first magnetic body 150 are all arranged in order of N pole→N pole→N pole→N pole in the clockwise direction, and the plural second permanent magnets 164 of the second magnetic body 160 are all arranged in order of S pole→S pole→S pole→S pole in the clockwise direction, so that the magnetic force (attraction) is generated between the first and second permanent magnets 154 and 164 arranged in the radial direction in such a manner that they have different poles from each other.

Here, because the rotary force of the motor 100 is stronger than the magnetic force between the first and second permanent magnets 154 and 164 while the motor pulley 130 is forcedly rotated by the rotary shaft 120, the attraction does not work. However, when power supplied to the motor 100 is interrupted, because the attraction generated between the first permanent magnets 154 and the second permanent magnets 164 takes effect, it can prevent that the motor pulley 130 is rotated by itself.

Moreover, in the above embodiment, the shaft where the first magnetic body 150 is fixed is set as the rotary shaft 120 of the motor 100 and the fixed face where the second magnetic body 160 is fixed is set as the inner circumferential surface of the motor housing 140 joined to the motor base 110 on which the rotary shaft 120 of the motor 100 is mounted. However, the first magnetic body 150 may be mounted on a certain rotary shaft which is rotated in interlock with opening and closing of the elevator door and the second magnetic body 160 may be mounted on a certain fixture arranged on the outer circumferential portion of the first magnetic body 150. For instance, the first magnetic body 150 may be mounted on the driven pulley mounted on the opposite side of the motor 100, and a housing structure is disposed on the outer circumferential portion of the driven pulley and the second magnetic body 160 may be mounted on the inner circumferential surface of the housing structure.

Now, an operational process of the elevator door stopping device according to the present invention will be described.

First, because the rotary shaft 120 is rotated when the motor 100 is operated, the motor pulley 130 joined integrally with the outer circumferential surface of the rotary shaft 120 is rotated in interlock with the rotary shaft 120. According to forward and backward rotation of the motor pulley 130, the timing belt which connects the motor pulley 130 with the driven pulley located in the opposite side of the motor pulley 130 is moved in a lateral direction, and then, right and left car doors respectively connected to the upper portion and the lower portion of the belt are opened or closed (Refer to the prior art described above). In this instance, because the rotary force of the motor 100 is stronger than attraction by the magnetic force between the first and second permanent magnets 154 and 164 while the motor pulley 130 is forcedly rotated by the rotary shaft 120, the attraction does not work.

After the car doors are opened or closed by the rotary force of the motor 100, when power supplied to the motor 100 is interrupted, rotations of the rotary shaft 120 and the motor pulley 130 are stopped, and at the same time, the attraction generated between the first permanent magnets 154 and the second permanent magnets 164 takes effect, so that the second magnetic body 160 stops rotation and keeps a fixed state. So, because the motor pulley 130 is prevented from rotating by itself, the opened state of the car doors can be kept. Therefore, the present invention can prevent accidents, for instance, passengers or firefighters on the elevator are bumped into the car doors while getting off the elevator in case of emergency, such as fire, so that they can carry out firefighting in safety.

As described above, the elevator door stopping device according to the present invention includes: the first magnetic body 150 mounted on the motor pulley 130 rotated in interlock with the rotary shaft 120 of the motor so as to generate the magnetic force in the radial direction perpendicular to the rotary shaft 120; and the second magnetic body 160 mounted on the inner circumferential portion of the motor housing 140 spaced apart from the first magnetic body 150 at the predetermined interval in the radial direction in such a way as to have the opposite pole to the first magnetic body 150, so that the magnetic force (attraction) is generated between the first magnetic body 150 and the second magnetic body 160 in the radial direction perpendicular to the rotary shaft 120, thereby preventing that the car doors are closed by themselves because rotation of the motor pulley 130 is stopped by the attraction between the first and second magnetic bodies 150 and 160 and power transmission to the driven pulley is interrupted when power supplied to the motor 100 is interrupted.

Furthermore, the elevator door stopping device according to the present invention can prevent the problem that noise and vibration are generated during the operation of the motor 100 because the rotary shaft 120 of the motor 100 is deviated from its original position due to the attraction between the first and second magnetic bodies 150 and 160 acting in the axial direction during an assembling process of motor components. Additionally, the elevator door stopping device according to the present invention can enhance assembly work of the motor because it can get out of from the effect by the magnetic force (attraction or repulsion) between the various motor components assembled in the axial direction and the internal magnetic bodies of the motor.

What is claimed is:

1. An elevator door stopping device to prevent an elevator door from closing by itself, the elevator door including a motor for opening and closing the elevator door, the elevator door stopping device comprising:

a first magnetic body fixed on a shaft rotating in interlock with opening and closing of the elevator door, the first magnetic body generating a first magnetic force in a radial direction perpendicular to the shaft, and a second magnetic body at a pre-determined interval from the first magnetic body in such a manner that the second magnetic body has an opposite pole to the first magnetic body, so that a second magnetic force is generated in a radial direction perpendicular to the shaft;

wherein the first magnetic body includes a first magnetic body plate and a plurality of first permanent magnets fixed along a circumferential surface of the first magnetic body plate;

wherein the second magnetic body includes a second magnetic body plate and a plurality of second permanent magnets attached to a circumferential surface of the second magnetic body plate;

wherein the first magnetic body and the second magnetic body are concentric;

wherein the rotary force of the shaft when the motor is operated is stronger than the first magnetic force and the second magnetic force between the first magnetic body and the second magnetic body.

2. The elevator door stopping device of claim 1, wherein the plurality of first permanent magnets include six permanent magnets.

3. The elevator door stopping device of claim 1, wherein each of the plurality of first permanent magnets has a substantially circular arc shape with a back-to-forth width parallel to the shaft being larger than a radial thickness perpendicular to the shaft.

4. The elevator door stopping device of claim 1, wherein each of the plurality of first permanent magnets is arranged to have a different pole from its adjacent ones of the plurality of first permanent magnets.

5. The elevator door stopping device of claim 1, wherein each of the plurality of first permanent magnets is arranged to have a same pole as its adjacent ones of the plurality of first permanent magnets.

6. The elevator door stopping device of claim 1, wherein the first magnetic body plate includes a joining portion and a fixing portion formed integrally with the joining portion and extending perpendicularly therefrom, the fixing portion configured to attach the plurality of first permanent magnets thereon.

7. The elevator door stopping device of claim 6, wherein the joining portion is formed with a hole to receive the shaft therethrough.

8. The elevator door stopping device of claim 1, wherein each of the plurality of second permanent magnets is arranged to have a different pole from its adjacent ones of the plurality of second permanent magnets.

9. The elevator door stopping device of claim 1, wherein each of the plurality of second permanent magnets is arranged to have a same pole as its adjacent ones of the plurality of second permanent magnets.

10. An elevator door stopping device to prevent an elevator door from closing by itself, the elevator door stopping device comprising:

a first magnetic body fixed on a shaft rotating in interlock with opening and closing of the elevator door, and a second magnetic body at a pre-determined interval from the first magnetic body in such a manner that the second magnetic body has an opposite pole to the first magnetic body, so that a magnetic force is generated between the first magnetic body and the second magnetic body in the radial direction perpendicular to the shaft;

wherein the first magnetic body includes a first magnetic body plate and a plurality of first permanent magnets fixed along a circumferential surface of the first magnetic body plate;

wherein the first magnetic body plate includes a joining portion and a fixing portion formed integrally with the joining portion and extending perpendicularly therefrom, the fixing portion configured to attach the plurality of first permanent magnets thereon;

wherein the first magnetic body plate further comprises a support jaw on an outer edge where the joining portion and the fixing portion meet together, the support jaw configured to support the plurality of first permanent magnets and to maintain a distance between the plurality of first permanent magnets and the joining portion.

11. An elevator system, comprising:

at least one elevator door; and an elevator door stopping device comprising a first magnetic body fixed on a shaft of a motor, the first magnetic body generating a first magnetic force in a radial direction perpendicular to the shaft and a second magnetic body at a pre-determined interval from the first magnetic body, the second magnetic body generating a second magnetic force in a radial direction perpendicular to the shaft;

wherein the first magnetic body includes a first magnetic body plate and a plurality of first permanent magnets fixed along a circumferential surface of the first magnetic body plate;

wherein the second magnetic body includes a second magnetic body plate and a plurality of second permanent magnets attached to a circumferential surface of the second magnetic body plate;

wherein the first magnetic body and the second magnetic body are concentric;

wherein the rotary force of the shaft when the motor is operated is stronger than the first magnetic force and the second magnetic force between the first magnetic body and the second magnetic body.

12. The elevator system of claim 11, wherein the motor further comprises a motor pulley connected to an outer surface of the shaft, the motor pulley configured to rotate with the shaft to operate the at least one elevator door.

* * * * *